United States Patent [19]

Garner

[11] 4,252,583

[45] Feb. 24, 1981

[54] METHODS OF FLUIDIZED POWDER FILLING OF CABLE CORES

[75] Inventor: John N. Garner, Pointe Claire, Canada

[73] Assignee: Northern Telecom Limited, Montreal, Canada

[21] Appl. No.: 100,042

[22] Filed: Dec. 4, 1979

Related U.S. Application Data

[62] Division of Ser. No. 930,236, Aug. 2, 1978, Pat. No. 4,205,515.

[51] Int. Cl.[3] ..... H01B 13/06

[52] U.S. Cl. ..... 156/48; 57/1 UN; 57/101; 118/634; 118/DIG. 5; 118/DIG. 19; 141/250; 141/290; 156/47; 174/102 P; 174/116; 174/118; 308/DIG. 1; 366/101

[58] Field of Search ..... 29/614, 616; 118/634, 118/DIG. 5, DIG. 19; 141/250, 290; 156/102 P, 116, 118; 222/195; 338/238; 366/101; 427/117, 118, 120, 185; 57/1 UN, 101; 308/DIG. 1

[56] References Cited

U.S. PATENT DOCUMENTS

| | | | |
|---|---|---|---|
| 3,152,845 | 10/1964 | Ertaud et al. | 308/9 |
| 3,324,643 | 6/1967 | Kluttz | 57/101 X |
| 3,696,599 | 10/1972 | Palmer et al. | 57/1 UN |
| 3,707,836 | 1/1973 | Lovett | 57/1 UN |
| 3,744,858 | 7/1973 | Weichsel | 308/5 R |
| 3,889,455 | 6/1975 | Portinari et al. | 156/48 X |
| 3,972,304 | 8/1976 | Boucher | 118/44 |
| 4,100,002 | 7/1978 | Woytiuk et al. | 156/48 |
| 4,122,212 | 10/1978 | Walling et al. | 427/27 |

*Primary Examiner*—William A. Powell
*Assistant Examiner*—Robert A. Dawson
*Attorney, Agent, or Firm*—Sidney T. Jelly

[57] ABSTRACT

For powder filling of cables, in a fluidized powder bed, it has been proposed to pass the cable core through the bed in a substantially closed condition. There is a limit to the number of conductors a core can have for effective filling. In the present invention the cable core is opened up into a number of core units by passing through an opening member. The opening member is freely ridable on the cable core and has a hole for each unit. The opener is held against a support member and an air bearing formed between the two members. Air is also usually fed to the holes in the opener member through which the core units pass to prevent flow of powder out from the bed. The opening member can be positioned in the fluidized bed or outside immediately prior to passage of the cable core through the bed. The units are each in a substantially closed condition in the bed and the units close to a single core also in the bed.

4 Claims, 7 Drawing Figures

METHODS OF FLUIDIZED POWDER FILLING OF CABLE CORES

This application is a division of application Ser. No. 930,236 filed Aug. 2, 1978 and now U.S. Pat. No. 4,205,515.

This invention relates to methods of fluidized powder filling of cable cores and is essentially concerned with the filling of multiple core unit cable cores.

In copending application Ser. No. 921,252 filed July 3, 1978, now abandoned, in the name of the present assignee there is described the fluidized powder filling of a cable core by passing the cable core through a fluidized bed in a substantially closed condition. There appears to be a limit to the size of cable core which can effectively be filled, and in the case of a telecommunications cable having a core composed of a multiplicity of pairs of conductors, a convenient maximum unit size is fifty pairs of conductors.

For cables having more than this number of conductors, the cable core is "opened" to form a number of core units, each unit being in a substantially closed condition as it passes through the fluidized bed. The cable core can be opened before or after entering the fluidized bed, and closes back again in the bed.

In its broadest aspect, the invention is concerned with an opening device for opening a cable core into a plurality of core units, with the individual units being powder filled in a substantially closed condition. The opening device can be positioned in the fluidized bed or outside the bed prior to passage of the cable core through the bed. The device comprises an opening member freely riding on the cable core and supported against a support member through an air bearing arrangement.

The invention will be readily understood by the following description of certain embodiments, by way of example, in conjunction with the accompanying drawings, in which.

Figure 1:
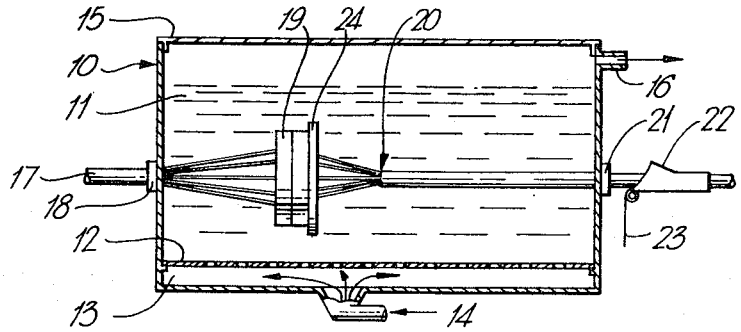
FIG. 1 is a diagrammatic longitudinal cross-section through a filling bed with an opening device in the bed.

As illustrated in FIG. 1, a fluidized powder filling bed is indicated generally at 10, the powder being in the main portion 11 having a perforated base member 12, an air box 13 under the member 12, with an air supply at 14. The main portion is covered by a lid 15 and dust extraction is provided at 16. The bed can be supplied with powder either by removing the lid or by providing an inlet. A typical form of bed is illustrated in the above mentioned application.

A cable core 17 enters via an inlet die 18 and then the core is opened by the core units passing through an opening device 19. After passage through the opening device the core units close together, as indicated at 20, and then exit through an exit die 21. After passing through the exit die the core can be wrapped, for example by a tape wrapping device 22 and tape 23. The opening device can be supported in the bed by a support plate 24 extending across the main portion 11.

Figure 2:
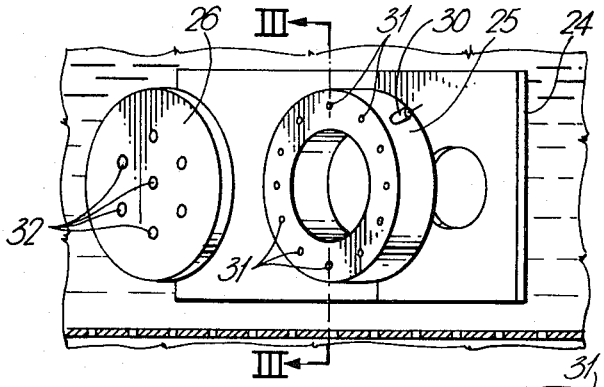
FIG. 2 is a diagrammatic perspective view of the two basic parts of the device, shown spaced apart for clarity.
Figure 3:
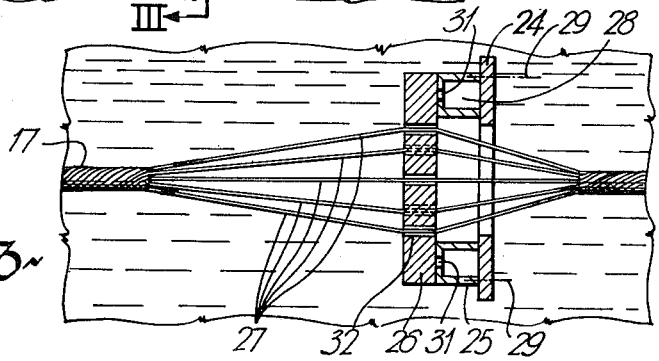
FIG. 3 is a cross-section on the line III—III of FIG. 2, with the device as in use.

The opening device 19 is illustrated in more detail in FIGS. 2 and 3. The device comprises a support member 25 attached to the support plate 22, and an opening member 26 which rides on the cable core 17, the core opens up into a plurality of core units 27. Support member 25 is annular in form and has an annular passage 28 formed from the back surface. The back surface of the support member is held tight against the support plate 22, as by screws at 29, and pressurized air is fed to the passage 28 via an inlet 30. Formed in the front face of the support member 25 are a number of small orifices 31 communicating with the passage 28. In operation, with the opening member 26 riding on the cable core, the drag on the opening member holds it against the support member 25, and the opening member is also maintained in alignment with the support member. High pressure air feeds through the orifices 31 and supports the opening member 26 a short distance away from the support member, allowing virtually friction free relative movement. The air also prevents fluidized powder penetrating between the two members. Holes 32 are formed through the opening member 26 for passage of core units therethrough.

To start the operation, the cable core is divided into the required number of core units after passage through the inlet die 18. While seven are shown in FIGS. 2 and 3, a smaller number can occur, or a larger number. For large cable cores more than one row of holes 32 can be provided in the opening member. The individual core units are then put through the holes 32, then through the centre of the support member 25 and then out through the exit die 21. Usually a pulling member is attached to the end of the cable core to lead it through any successive stages and on to the take-up spool. The bed is then closed, air admitted to the air box 13 and the powder fluidized. The cable core is pulled through the bed, the core opening to pass through the opening member 26 and then closing again. The powder fills the interstices between the conductors in each core unit prior to the cable core closing together. There is some twist in the core units, about the longitudinal axis of the core, and the opening member 26 can rotate relative to the support member 25 quite easily.

Figure 4:
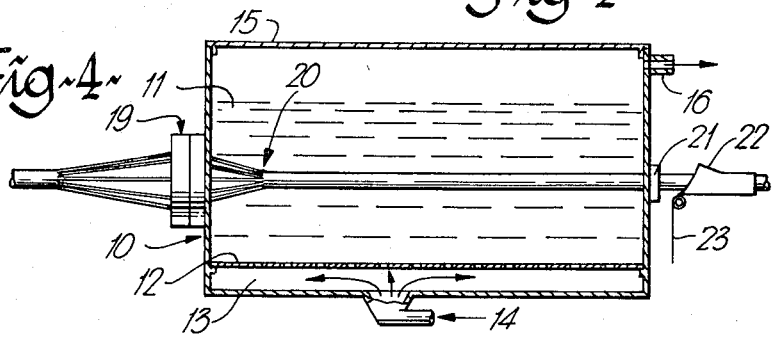
FIG. 4 is a diagrammatic longitudinal cross-section through a filling bed with an opening device outside the bed, before entry of the cable core.

FIG. 4 illustrates diagrammatically an alternative arrangement in which the opening device 19 is mounted on the outside of the bed 10 at the inlet to the filling portion 11. Where applicable the same reference numerals are used in FIG. 4, and in FIGS. 5 and 6, for the same items as in FIGS. 1 to 3. The cable core is opened into units before entering the fluidized bed, closing again in the bed, at 20.

Figure 5:
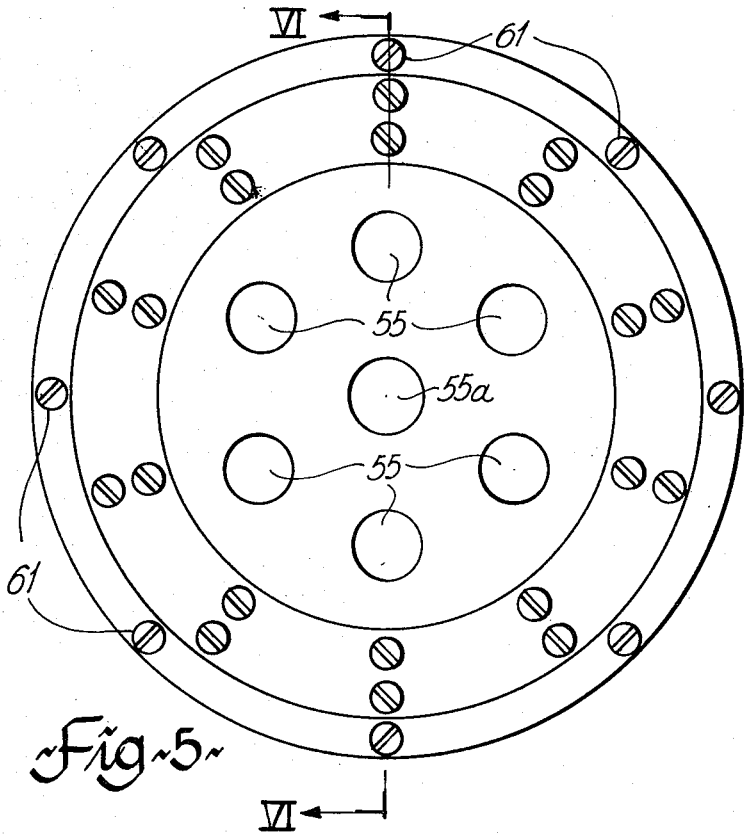
FIG. 5 is a front view of the opening device in FIG. 4, as it would be seen in the direction of the arrow A in FIG. 4.
Figure 6:
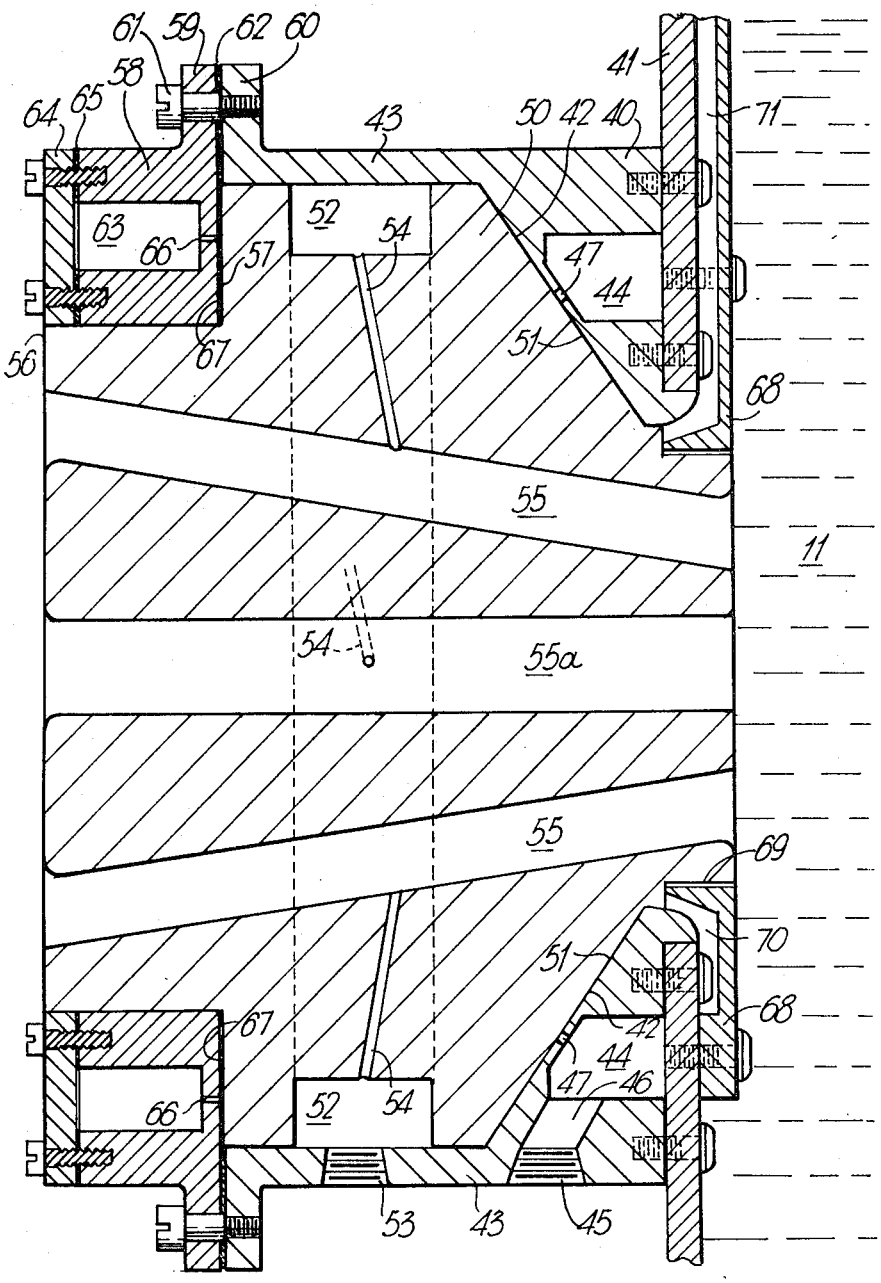
FIG. 6 is a cross-section on the line VI—VI of FIG. 5, illustrating the opening device in more detail.

FIGS. 5 and 6 illustrate in more detail the opening device 19 of FIG. 4. In this example a support member 40 is attached to the inlet end wall 41 of the main portion 11 of the bed. The support member 40 is tubular and has a conical support surface 42 and an annular wall 43 extending from the outer periphery of the conical surface forming a chamber. An annular channel 44 is formed in the back of the support member and pressurized air is supplied to this channel via an inlet 45 connecting passage 46. Small orifices 47 extend from the support surface 42 through to the channel 44.

Positioned within the support member 40 is an opening member 50. The opening member has a forward, conical surface 51 which is in opposition to surface 42. The periphery of the opening member is also a freely moveable fit inside the wall 43. An annular chamber 52 is formed in the periphery of the opening member and pressurized air is fed to this chamber via an inlet 53. From the chamber 52 air is fed via small diameter bores 54 to holes 55 and 55*a* extending through the opening member and through which pass the core units. The feature of the air supply bores 54 will be described later.

The rearward surface 56 of the opening member 50 is recessed around the periphery to provide a rearward bearing surface 57, and a retaining member 58 is positioned in the recess. The retaining member has a radially extending flange 59 which mates with a radially extending flange 60 on the support member 40 and screws 61 connect the two flanges together. A gasket 62 can be positioned between the flanges. The retaining member has an annular cavity 63, closed by a cover plate 64 with a gasket 65. Small orifices 65 connect the cavity 63 with the front surface 67 of the retaining member. Pressurized air is fed to the cavity 63 via an inlet, not shown.

In operation, once the cable core has been initially opened and the core units passed through the holes 55, and 55*a* through the bed 10, out through the unit die 21 and on to the take up spool, air is supplied to the air box 13 to fluidize the powder and also to the channel 44, chamber 52 and cavity 63.

The pressurized air fed to the channel 44 and cavity 63 flows through the orifices 47 and 66 and forms an air bearing between the support member and the opening member. There is thus virtually no friction between support member and opening member. Air will also flow between the outer periphery of the opening member and the inner surface of the wall 43.

Figure 7:
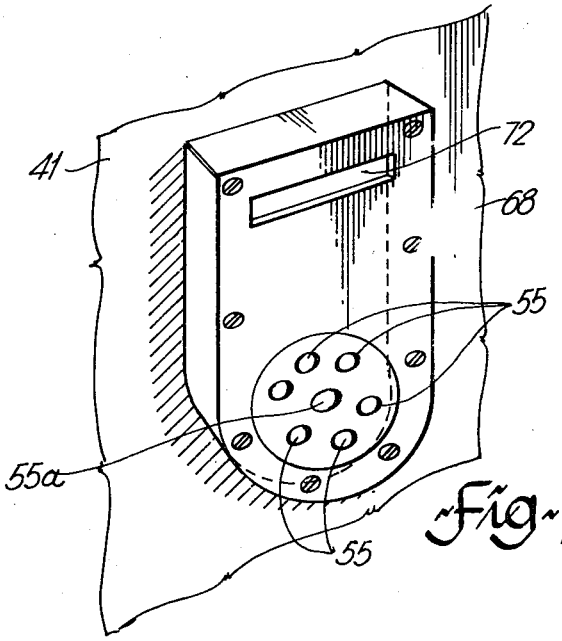
FIG. 7 is a perspective view on the inner face of the inlet wall of the bed, showing an air collector.

Although the core units are passing through the holes 55 and 55*a* at a fairly high speed, say over 100 ft. per minute, powder tends to escape from the bed out through the holes. By feeding air in via inlet 53, chamber 52 and bores 54, a small net flow of air into the bed can be achieved, preventing outflow of powder. The flow of this air can be controlled so that powder leakage is just prevented. The air flowing from the orifice 47 between conical surfaces 42 and 51 flows out from between these surfaces at the mounting position on the end wall 41. This flow could interfere with the fluidized bed and a collection system can be provided. As seen in FIGS. 6 and 7, collector member 68 is attached to the inside of the wall 41, the inner periphery of the member 68 situated in a recess 69 in the forward end of the opening member. The inner portion of the member 68 is recessed on the side facing the support member 40 and opening member 50 and forms an annular conduit 70 into which the air flows from between surfaces 42 and 51. The annular conduit 70 connects via a passage 71 to an outlet 72 opening into the space above the bed at 11. The bed exhaust is slightly below atmosphere pressure. Similarly, an air supply can be provided to feed air to the holes 32 in the opening member of FIGS. 1, 2 and 3.

Thus the opening member 50 rides freely on the cable core and can rotate freely within the support member as the cable core passes through the bed. The number of holes 55 can vary depending upon core size and number of core units. More than one row of holes 55 can be provided, as necessary. It is also possible to provide an opening member with a large number of holes 55, with means for blocking those holes not used.

As a typical example, the bed 10 can be 4 ft. long. The cable core units close down at a position which can vary from about 6" to about 18" from the inlet wall. The larger the cable the greater the distance the closing down from the inlet. The bed can be made shorter, but the size given will accommodate various cable sizes. It is believed that the length of bed beyond the closing down of the core units evens out the filling, but the majority of the filling occurs at the beginning before the core units close down. A typical air supply pressure is about 80 psi although this can vary and lower pressures have been used. The air flows are quite small. The size of the holes 32 and 55 will depend upon the size of the cable core units passing therethrough. As an example, for the arrangement as illustrated in FIGS. 5 and 6, the following table gives typical dimensions for a telecommunications cable, in which the cable core has been divided up so that core units of alternately twelve and thirteen pairs pass through holes 55, and a twenty-five pair unit passes through hole 55*a*. Other numbers of pairs per unit can be provided with corresponding adjustment to the hole diameters.

| Wire Gauge | Holes 55 | Hole 55a |
|---|---|---|
| 24 | .358" dia. | .468" dia. |
| 22 | .397" dia. | .515" dia. |
| 26 | .316" dia. | .406" dia. |
| 19 | .531" dia. | .703" dia. |

What is claimed is:

1. A method of fluidized powder filling a multiple core unit cable core, comprising opening said cable core to space-apart said multiple core units, each containing a multiplicity of conductors, feeding said core units, each with its conductors closed together, through a fluidized powder bed, the powder in the bed flowing into the interstices between conductors of each unit, and closing said core units into a cable core in said fluidized powder bed.

2. A method as claimed in claim 1, including opening the cable core by passing the core units through holes in an opening member freely ridable on the cable.

3. A method as claimed in claim 2, including feeding pressurized air to said holes in said opening member to prevent escape of powder from said bed through said holes.

4. A method of fluidized powder filling a multiple core unit cable core with each unit comprising a multiplicity of conductors, comprising opening said cable core to space-apart said multiple core units by passing the core units divergently towards and through a plurality of axially extending and spaced-apart holes defined in a core opening member, applying pressurized air between the opening member and a support member to form an air bearing there between and allow for free rotation of the opening member, feeding the spaced core units, each with its conductors closed together, through a fluidized powder bed, the powder in the bed flowing into the interstices between conductors of each unit, and causing the core units to close together within the fluidized bed and after passing through the holes so as to reclose the cable core, the twist of the core units in the core causing the opening member to rotate with substantially no frictional resistance to rotation.

* * * * *